US005820217A

United States Patent [19]

Horner et al.

[11] Patent Number: 5,820,217

[45] Date of Patent: Oct. 13, 1998

[54] FURNITURE GLIDE SYSTEM

[76] Inventors: Paul W. Horner, 9124 W. 91st Ter., Overland Park, Kans. 66202; Roger A. Babcock, Rte. 4, Box 258, Oak Grove, Mo. 64075

[21] Appl. No.: 841,845

[22] Filed: May 5, 1997

[51] Int. Cl.[6] ..... A47C 1/02

[52] U.S. Cl. ..... 297/344.11; 297/463.1; 248/688; 248/188.8; 403/11

[58] Field of Search ..... 297/344.1, 272.1, 297/452.2, 463.1, 272.2; 248/688, 188.9, 188.8; 403/363, 391, 399, 397, 11

[56] References Cited

U.S. PATENT DOCUMENTS

| | | | |
|---|---|---|---|
| 2,888,775 | 6/1959 | Thoeming | 248/188.9 |
| 3,254,362 | 6/1966 | Rasor et al. | 248/188.8 X |
| 4,915,335 | 4/1990 | Miles | 248/188.8 |
| 5,160,105 | 11/1992 | Miller | 248/188.9 |
| 5,513,900 | 5/1996 | Iglesias | 297/463.1 |

*Primary Examiner*—Laurie K. Cranmer
*Attorney, Agent, or Firm*—Litman, McMahon & Brown, L.L.C.

[57] ABSTRACT

A furniture glide system for a furniture piece having a horizontal lower support member includes a pair of opposed outwardly facing indentations on the lower support member and a glide. The glide is generally channel-shaped with a pair of opposed, inwardly projecting bosses. When the glide is installed on the furniture piece, it retains the furniture piece lower support member in the channel and the shoulders of the indentations engage corresponding surfaces on the bosses to secure the glide against axial travel and rotation about the lower support member. The sidewalls of the glide may be notched above the bosses for receiving a shoulder which projects outwardly from the indentation in the lower support member. The sidewalls and end walls of the glide may be angled to impart stability and to facilitate sliding of the furniture piece over floor surfaces.

17 Claims, 5 Drawing Sheets

FURNITURE GLIDE SYSTEM

BACKGROUND OF THE INVENTION

1. Field of the Invention

The present invention is broadly concerned with an improved furniture glide system for a furniture piece having a horizontal lower support member. The glide system has numerous advantages including secure, fixed engagement of the glide member to the furniture frame in order to prevent rotation of the glide or sliding along the support during use without the use of additional fasteners, ease of installation and removal and smooth sliding over carpeted surfaces. More particularly, it is concerned with a system having a pair of opposed, outwardly facing indentations on the lower support member and a generally channel-shaped glide. The glide is equipped with inwardly projecting bosses for registry with corresponding indentations in the lower support member.

2. Description of the Related Art

Wire frame chairs with closed-loop legs are particularly popular for commercial uses because they are economical and sturdy, yet are relatively lightweight and easily portable. Moreover, they are well suited for stacking. Prior art glides fit coaxially over the floor-engaging lower support portion of the chair to facilitate sliding of the chair over the surface beneath so that the chair moves smoothly, quietly and without marring the surface beneath. However, such glides may travel along the wire and bunch up, causing the chair to rock because it is not level. The glides may also rotate around the wire as well, so that the shoulders of the channel scrape the floor surface, impairing sliding of the chair and causing the glide to wear. Additional fasteners, such as screws, may be employed to secure the glides against travel and rotation. However, specialized tools are required for installation of such glides with fasteners.

Previous attempts to construct glides having a central stem for registry with a predrilled hole in the wire have encountered difficulties with burrs formed by predrilling of the wire. In addition, there have been problems with breakage of glide stems unable to withstand longitudinal forces exerted against the glide as the chair is slid forward and backward by a seated person.

SUMMARY OF THE INVENTION

The present invention overcomes the problems previously outlined and provides a greatly improved furniture glide system which does not rotate about or travel along the lower support member, does not require additional fasteners, is easy to install and replace without tools and which smoothly slides over carpeted surfaces.

The furniture glide system in accordance with the present invention broadly includes a pair of opposed, outwardly facing indentations in the horizontal lower furniture support member and a generally channel-shaped glide with a pair of opposed, inwardly projecting bosses. When the glide is installed on the furniture piece, it retains the furniture piece lower support member in the channel and the shoulders of the indentations engage corresponding surfaces on the bosses to secure the glide against axial travel and rotation about the lower member. In a preferred embodiment, the sidewalls of the glide are notched above the bosses for receiving a shoulder which projects outwardly from the indentation in the lower member. The sidewalls and end walls of the glide may be angled to facilitate sliding of the furniture piece over floor surfaces.

OBJECTS AND ADVANTAGES OF THE INVENTION

The principal objects and advantages of the present invention include: providing a glide system for a furniture piece which prevents both rotation of the glide about the horizontal lower support member and axial movement along the member; which may be installed and replaced easily and without tools; which permits field-adding and servicing of glides; which does not require additional fasteners, especially screw-type fasteners which may cause burrs; which slides easily over carpeted services; which may be constructed of plastic or rubber; which is of simple, economical construction; and which is particularly well-adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
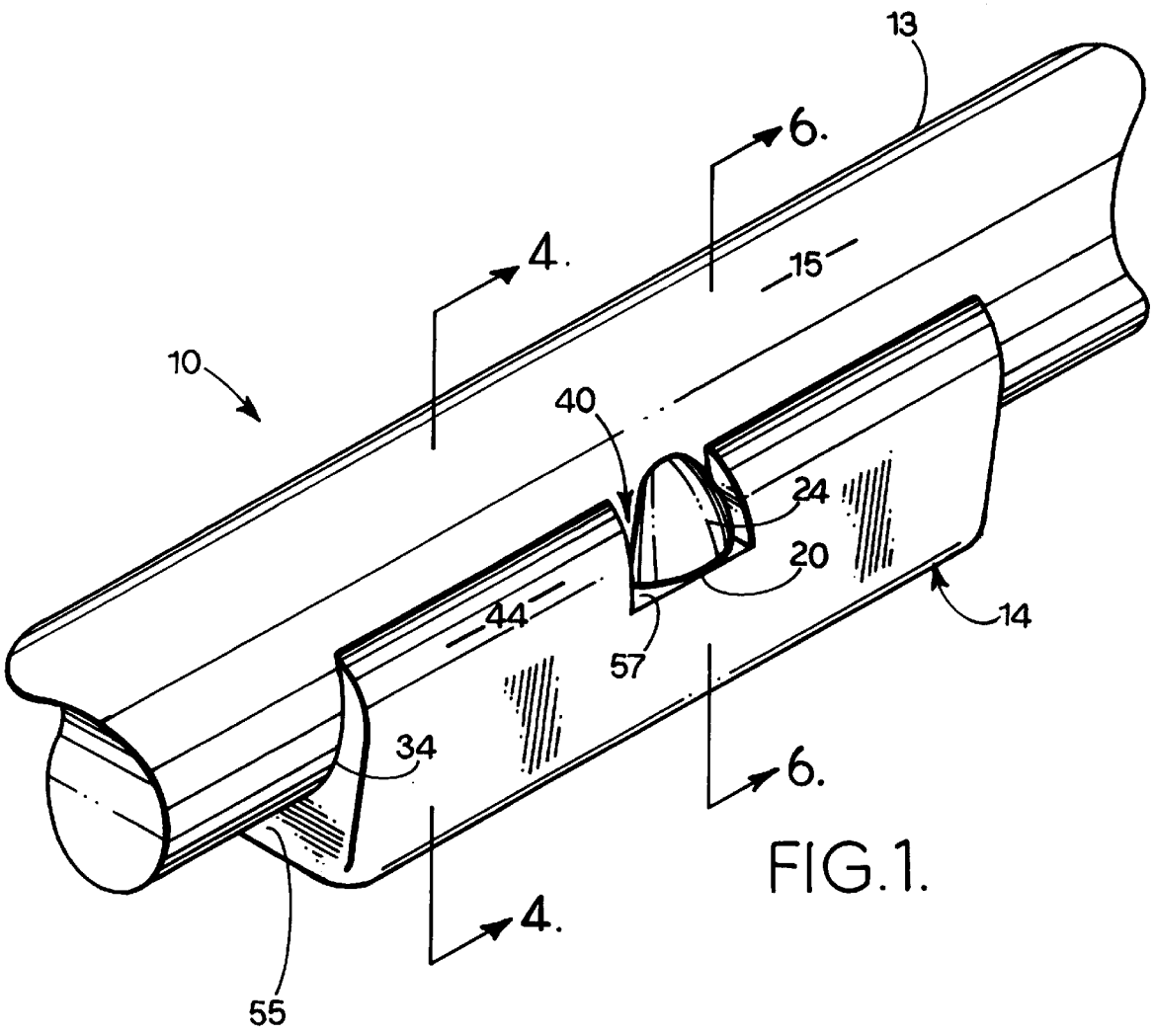
FIG. 1 is a perspective view of a glide system in accordance with the present invention showing a glide and fragmentary horizontal lower support member of a furniture piece, with the glide member installed on the lower member.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring now to the drawing, a glide system 10 for use with a furniture piece 12 in accordance with the invention broadly includes a shaped lower support member 13 and a glide 14.

II. Furniture Piece Lower Support Member 13

Lower support member 13 is elongate and generally horizontal and includes an exterior surface 15, and a pair of outwardly opening indentations 16, 18, each surmounted by a shoulder 20, 22.

Indentations 16, 18 may be formed in the support member 13 by punching, machining, molding or any other known method. The indentations are not contiguous, so that there remains a longitudinally oriented rib 23, which extends generally downwardly therebetween. Where the horizontal lower support member indentations 16, 18 are formed by punching, the indentation shoulders 20, 22 may extend outwardly from exterior surface 15 to form upsets 24, 25.

The glide system of the present invention may be employed with a furniture piece constructed of a material such as metal, wood, synthetic resin, or any other suitable material. So-called wire frame chairs present an especially preferred embodiment, although other forms of frame, such as tubular, may be employed. In addition, other furniture pieces having generally horizontal lower support members, such as tables, ottomans and cabinets, as well as toys, such as spring-type rocking horses, may employ the present invention to good effect.

III. Glide 14

As best shown in FIGS. 2–9, the glide 14 includes a base 26 and a pair of upstanding sidewalls 27, 28 and end walls 30, 32, forming a generally upwardly facing open channel 34 therebetween. Bosses 36, 38 project into the channel.

In more detail, the glide 14 is of integral construction and is preferably formed of a lightweight synthetic resinous material, such as a polycarbonate, e.g., M-50 manufactured by Miles (Mobay) or Lexan® manufactured by the General Electric Company. Sidewalls 27, 28 include open notches 40, 42. The notches may serve as guides for orienting the horizontal lower support member 13 so that shoulders 20, 22 align with upsets 24, 25. Sidewalls 27, 28 present exterior surfaces 44, 46 and interior surfaces 48, 50.

The base 26 includes a center portion 52 and a lowermost surface 54. Exterior sidewall surfaces 44, 46 each subtend an angle A of 96° with the base lowermost surface 54, imparting lateral stability to the glide 14. Center portion 52 may be of relatively thin construction, since it need not be apertured to accommodate a fastener device. End walls 30, 32 present exterior surfaces 55, 56, each of which subtend an angle B of 92.5° with base lowermost surface 54, enhancing sliding of the furniture piece over a flooring surface. Bosses 36, 38 each present an engagement face 57, 58 and a channel face 60, 62, the faces cooperatively forming a generally upwardly-facing slot 64 in the channel 34.

The glide 14 may be constructed of rubber, synthetic resin or any suitable material. Synthetic thermoplastic resins such as polycarbonate are particularly preferred.

IV. Installation and Operation

Figure 2:
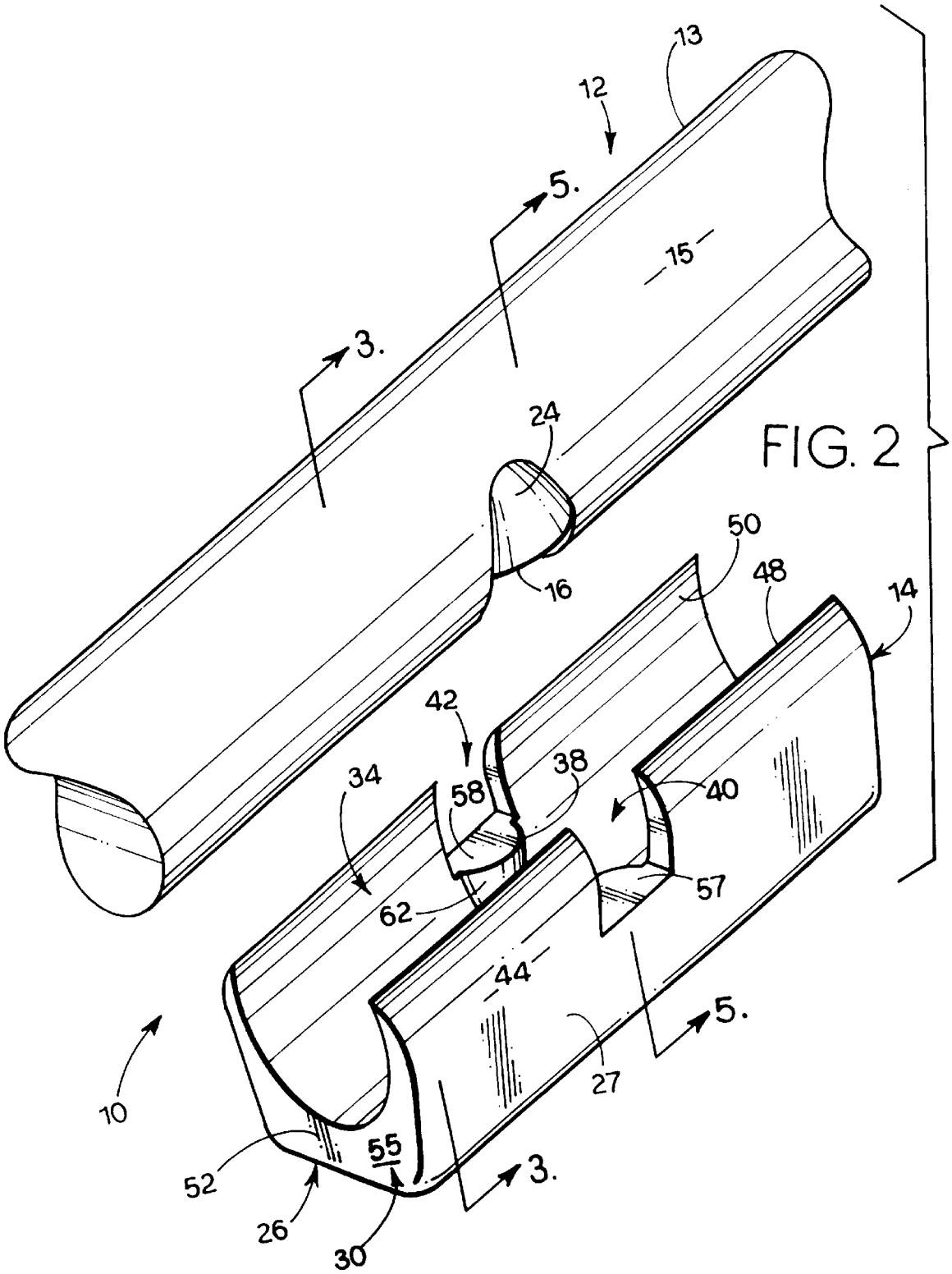
FIG. 2 is a perspective view of the glide system of FIG. 1 with the glide member removed from the lower member.
Figure 3:
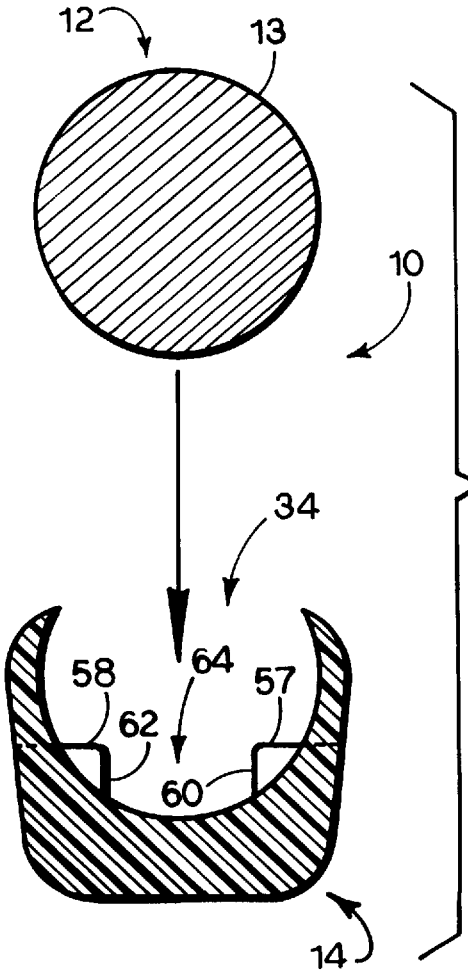
FIG. 3 is a cross section taken along line 3—3 of FIG. 2.
Figure 4:
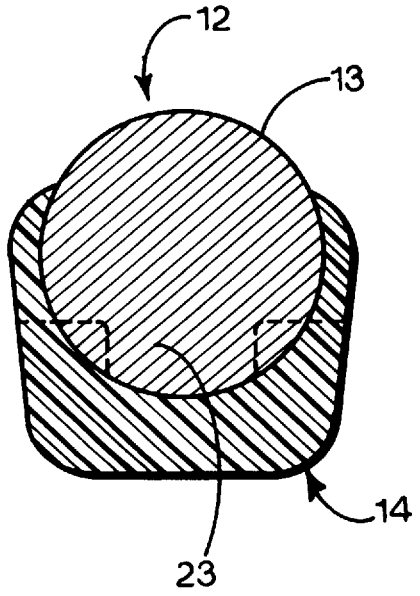
FIG. 4 is a cross-section taken along line 4—4 of FIG. 1.
Figure 5:
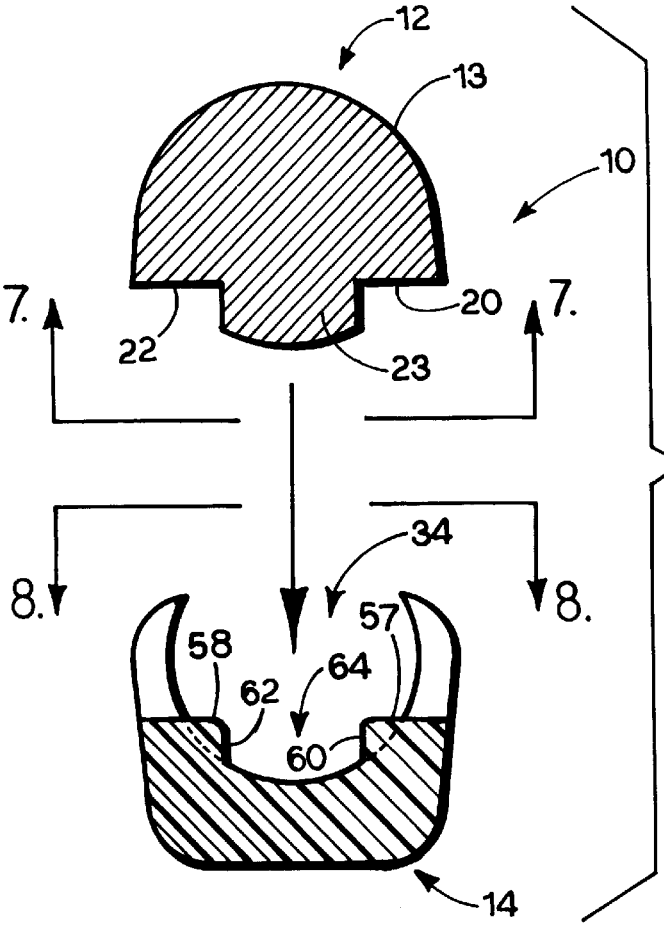
FIG. 5 is a cross-section taken along line 5—5 of FIG. 2.
Figure 6:
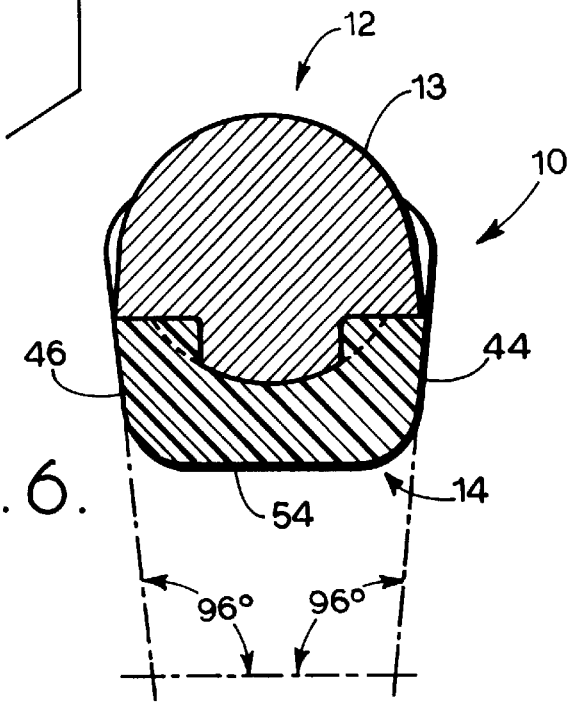
FIG. 6 is a cross-section taken along line 6—6 of FIG. 1, showing angle A.
Figure 7:
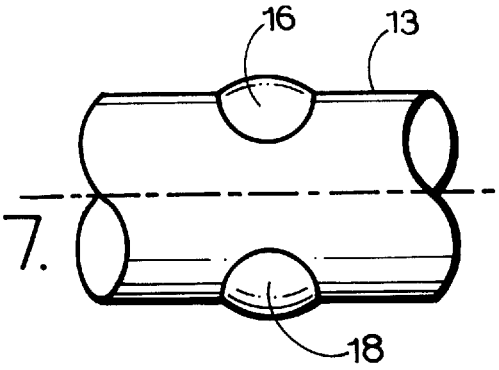
FIG. 7 is a bottom plan view of the lower support member taken along line 7—7 of FIG. 5.
Figure 8:
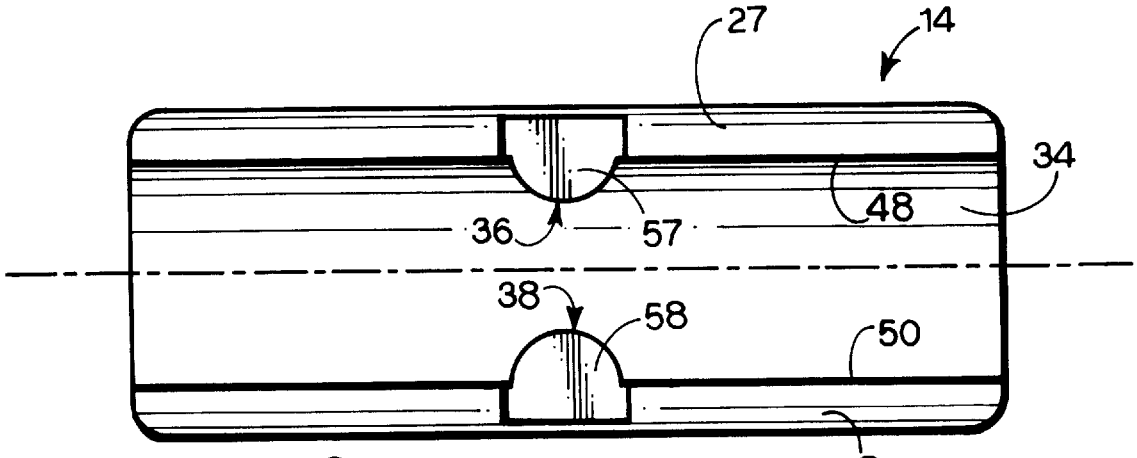
FIG. 8 is a top plan view of the glide member taken along line 8—8, of FIG. 5.
Figure 9:
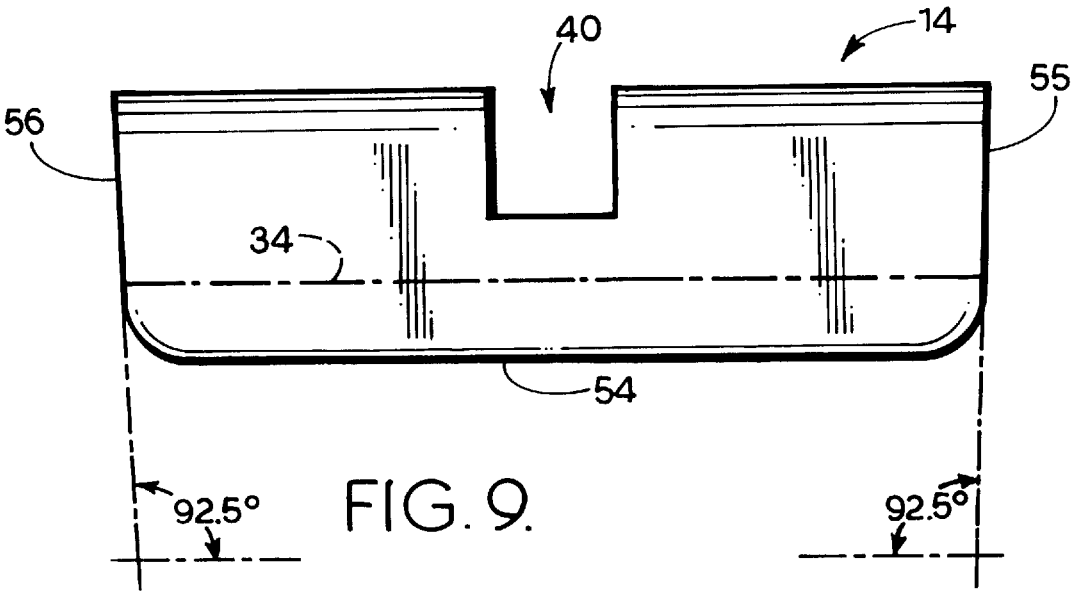
FIG. 9, is a side elevational view of the glide of FIG. 2, showing angle B.

As best shown in FIG. 2, glide 14 is installed on furniture piece 12 by positioning the glide adjacent furniture piece lower support member 13 so that notches 40, 42 clear shoulders 20, 22 respectively, and the two are simply snapped together as shown in FIGS. 1, 4 and 6. In place, boss engagement faces 57, 58 engage indentation shoulders 20, 22 and upwardly facing slot 64 accepts downwardly extending rib 23, thereby preventing both rotation and axial travel of the glide 14 about lower support member 12.

Those skilled in the art will appreciate that, while the glide system of the present invention has been described having pairs of bosses, indentations, shoulders, and engagement faces, it may be operatively constructed with a lower horizontal support member 13 having a single indentation presenting a shoulder for engagement of a glide 14 having a single boss with an engagement surface. In addition, while the glide system has been depicted and described in a generally vertical orientation, with the glide 14 installed below horizontal lower member 13, the system may be constructed so that glide 14 and its 24 are oriented at any other suitable angle generally towards the outside or inside of lower support member 13.

It is to be understood that while certain forms of the present invention have been illustrated and described herein, it is not to be limited to the specific forms or arrangement of parts described and shown.

What is claimed and desired to be secured by Letters Patent is as follows:

1. A glide system for a furniture piece having an elongated, generally horizontal lower member, which glide system comprises:

(a) an outwardly-open indentation formed in said furniture piece lower member, said indentation having a shoulder;

(b) said indentation shoulder projecting outwardly to form an upset; and (c) a glide, which includes:

(1) a base;

(2) a pair of sidewalls coupled with and extending upwardly from the base;

(3) a pair of end walls, each coupled with the base and the sidewalls;

(4) a channel formed by the base and the sidewalls, said channel extending between and being open at said end walls and sized and positioned to receive said lower member;

(5) a boss having an engagement face and projecting into said channel such that it is received in said shoulder indentation when said lower member is received in said channel; and (6) a notch in one of said sidewalls which receives said outwardly projecting upset when said boss and said indentation are engaged.

2. The glide system as set forth in claim 1, further comprising:

(a) said lower member having a pair of opposed indentations;

(b) said sidewalls having a pair of opposed notches; and (c) said indentation shoulders engaging said boss engagement faces and said notches receiving said upsets.

3. The glide system as set forth in claim 2, wherein:

(a) said indentations in said lower member cooperatively form a longitudinal rib; and (b) said bosses in said glide cooperatively form a slot for receiving said rib.

4. The glide system as set forth in claim 1, wherein the lower member is constructed of a material selected from the group consisting of wire and synthetic resin.

5. The glide system as set forth in claim 1, wherein said sidewalls and said base each present an exterior surface and said exterior surfaces of each of said sidewalls and said base subtend an angle of about 96°.

6. The glide system as set forth in claim 1, wherein said endwalls and said base each present an exterior surface and said exterior surfaces of each of said endwalls and said base subtend an angle of about 92.5°.

7. The glide system as set forth in claim 1, wherein said furniture piece comprises a chair.

8. A furniture piece comprising:

(a) a support surface and an elongated, generally horizontal lower member;

(b) said furniture piece lower member presenting an outwardly-open indentation, said indentation having a shoulder;

(c) said indentation shoulder projecting outwardly to form an upset; and (d) a glide, including:

(1) a base;

(2) a pair of sidewalls coupled with and extending upwardly from the base;

(3) a pair of end walls, each coupled with the base and the sidewalls;

(4) a channel formed by the base and the sidewalls, said channel extending between and being open at said endwalls and sized and positioned to receive said lower member;

(5) a boss having an engagement face and projecting into said channel such that it is received in said shoulder indentation when said lower member is received in said channel; and (6) a notch in one of said sidewalls for receiving said outwardly projecting upset when said boss and said indentation are engaged.

9. The furniture piece as set forth in claim 8, further comprising:

(a) said lower member having a pair of opposed indentations;

(b) said sidewalls having a pair of opposed notches; and (c) said indentation shoulders engaging said boss engagement faces and said notches receiving engaging said upsets.

10. The furniture piece as set forth in claim 9, wherein:

(a) said indentations in said lower member cooperatively form a longitudinal rib; and (b) said bosses in said glide cooperatively form a slot for receiving said rib.

11. The furniture piece as set forth in claim 8, wherein the lower member is constructed of a material selected from the group consisting of wire and synthetic resin.

12. The furniture piece as set forth in claim 8, wherein said sidewalls and said base each present an exterior surface and said exterior surfaces of each of said sidewalls and said base subtend an angle of about 96°.

13. The furniture piece as set forth in claim 8, wherein said endwalls and said base each present an exterior surface and said exterior surfaces of each of said end walls and said base subtend an angle of about 92.5°.

14. The furniture piece as set forth in claim 8, wherein said furniture piece further comprises a chair.

15. A glide system for use with a chair having an elongate, generally horizontal lower member, which glide system comprises:

(a) a pair of opposed, outwardly-open indentations formed in said chair lower member, said indentations each having a shoulder;

(b) said indentation shoulders each projecting outwardly to form an upset;

(c) a downwardly-extending longitudinal rib, cooperatively formed by said indentations; and (d) a glide, which includes:

(1) a base;

(2) a pair of sidewalls coupled with and extending upwardly from said base;

(3) said sidewalls and said base each presenting an exterior surface and said exterior surfaces of each of said sidewalls and said base subtending an angle;

(4) a pair of end walls, each coupled with the base and the sidewalls, (5) said endwalls and said base each presenting an exterior surface, and said exterior surfaces of each of said endwalls and said base subtending an angle;

(6) a channel formed by said base and said sidewalls, said channel extending between and being open at said end walls and sized and positioned to receive said lower member;

(7) a pair of opposed bosses each having an engagement face and projecting inwardly from said sidewalls into said channel such that the bosses are received in said shoulder indentations when said lower member is received in said channel;

(8) an upwardly-facing slot cooperatively formed by said bosses and said base and positioned to receive said rib;

(9) notches in said sidewalls for receiving said outwardly projecting upsets when said bosses and said indentations are engaged.

16. The glide system as set forth in claim 15, wherein said exterior surfaces of each of said sidewalls and said base subtend an angle of about 96°.

17. The glide system as set forth in claim 15, wherein said exterior surfaces of each of said endwalls and said base subtend an angle of about 92.5°.

* * * * *